United States Patent [19]

Fowler

[11] Patent Number: 4,465,992

[45] Date of Patent: Aug. 14, 1984

[54] DOUBLE-POLE DOUBLE-THROW PROXIMITY SWITCH

[75] Inventor: Gerald L. Fowler, Louisville, Ky.

[73] Assignee: General Equipment & Mfg. Co., Inc., Louisville, Ky.

[21] Appl. No.: 381,180

[22] Filed: May 24, 1982

[51] Int. Cl.[3] ..... H01H 36/00

[52] U.S. Cl. ..... 335/205; 335/128; 335/194; 335/200

[58] Field of Search ..... 335/128, 135, 200, 275, 335/276, 194, 205, 207

[56] References Cited

U.S. PATENT DOCUMENTS 3,864,652 2/1975 Zubaty et al. ..... 335/194

*Primary Examiner*—Harold Broome

*Attorney, Agent, or Firm*—M. C. Yeasting

[57] ABSTRACT

A magnetically actuated proximity switch is provided with a double-pole double-throw contact arrangement. To substantially equalize the contact pressures between the two poles a movable armature, to which the movable contacts are firmly attached, is loosely pivoted to rotate about a transverse axis to open or close the contacts and to rock about a longitudinal axis to divide the available operating force between the two poles of the switch.

1 Claim, 4 Drawing Figures

DOUBLE-POLE DOUBLE-THROW PROXIMITY SWITCH

BACKGROUND OF THE INVENTION

Magnetically actuated switches are commonly used to signal the presence or absence of a magnetically permeable object in the sensing area of the switch. These switches are all single-pole, either single-throw or double-throw. While double-pole double-throw contact arrangements are desirable, attempts to operate known double-pole contact arrangements in a proximity switch have been unsuccessful. Basically, the operating force available in a proximity switch is insufficient to ensure that both contacts of the double-pole arrangement are operative. The ordinary small relay has enough operating force so that the contacts may be resiliently mounted and the armature given enough over-travel to ensure that both poles are operative.

SUMMARY OF THE INVENTION

According to the invention, the movable contacts of a double-pole proximity switch are firmly mounted on the armature and the armature is pivotally mounted to pivot about a transverse axis to open or close the contacts. The pivotal mounting is further arranged for limited rotation of the armature about a longitudinal axis passing generally between the sets of contacts.

The limited rotation about the longitudinal axis results in substantially equal contact pressure on the engaged contacts.

A preferred embodiment is illustrated in the accompanying drawings.

DESCRIPTION OF THE PREFERRED EMBODIMENT

Figure 1:
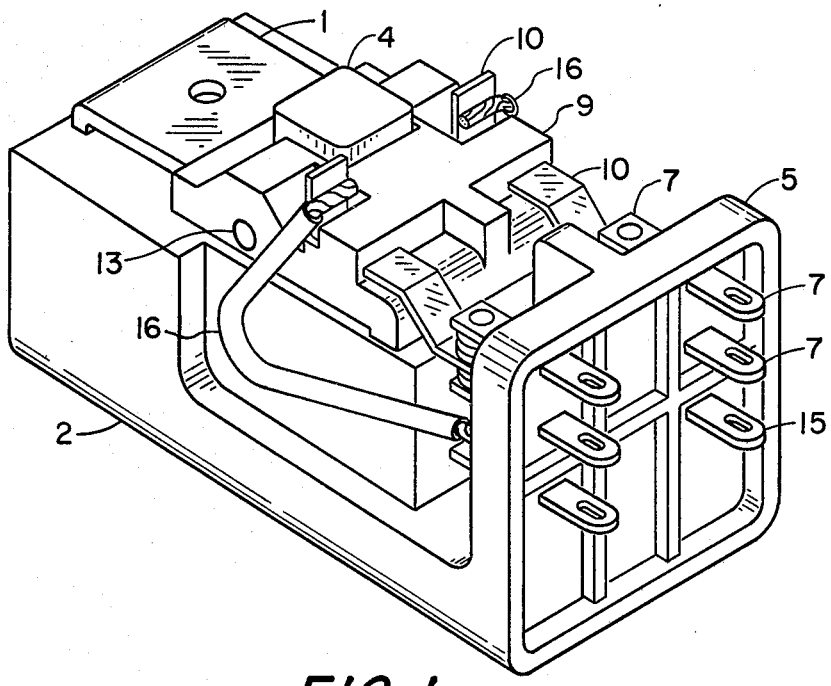
FIG. 1 is an isometric view of a double-pole proximity switch constructed according to the invention.

The improved proximity switch comprises an armature 1 that is pivotally mounted on a magnet holder 2. The magnet holder 2 includes a magnet 3, a pedestal 4, and an end wall 5. Fixed contacts 6 are mounted on terminals 7 that are molded in and extend through the end wall 5.

The armature 1, as shown in side elevation (FIG. 2), has its ends 8 turned down to form a shallow trough. About two thirds of the length of the armature is encased in plastic 9 which serves as a rigid insulating mount for a pair of contact leaves 10 carring contacts 11 that cooperate with the stationary or fixed contacts 6.

The armature 1 and encasing plastic has a rectangular opening that is a loose fit over the pedestal 4. A pivot pin 12 is fixed in a hole 13 extending through the plastic 9 parallel to the flat of the armature 1 and transverse to the length of the armature. The pivot pin 12 is a loose fit in a hole 14 in the pedestal 4 of the magnet holder. Preferably, but not necessarily, the hole 14 is tapered from each end so that the contact between the pin 12 and wall of the hole 14 is at or near the center of the pedestal 4.

The contact leaves 10 are connected through flexible leads 16 to terminals 15 molded in the end wall 5.

Figure 2:
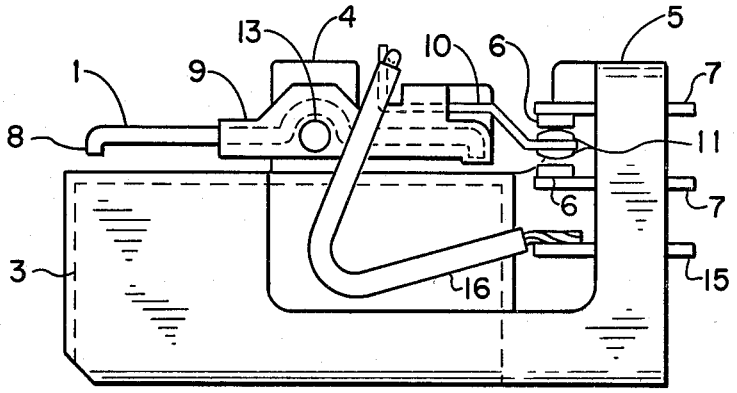
FIG. 2 is a side elevation of the improved switch.

The magnet 3 is in the form of a rectangular bar and is magnetized transversely of its length so that the face adjacent the armature 1 is of one polarity while the opposite face, remote from the armature, is of the opposite polarity. The armature 1 is pivoted off center with the exposed end remote from the contacts being of the greater length. Therefore, in the absence of any external magnetic material, the longer end is attracted to the magnet with greater force than is the shorter or contact carrying end. This closes the normally closed contacts, i.e. the fixed contacts 6 and the movable contacts 11 as seen in FIG. 2.

If a magnetically permeable object is brought near the end of the magnet holder 2 remote from the terminals 7 some of the magnetic flux from the magnet 3 to the armature 1 is diverted from the direct path to a second path extending from the upper corner of the magnet through the object and back to the lower corner of the magnet. This magnetic shunt path weakens the pull of the magnet 3 on that end of the armature 1 so that the magnetic pull on the contact end of the armature prevails and the armature moves to close the normally open contacts, i.e. the contacts 11 and the lower contacts 6.

This arrangement is significantly different from the ordinary small double-pole double-throw relay. The armature of a relay is carried on a hinge that prevents any rocking or rotation of the armature about its longitudinal axis. Because of the hinge the movable contacts must be carried on current carrying springs that are yieldable so that both of the current carrying springs are deflected when the armature reaches its closed position. In contrast, in the new proximity switch the armature is allowed to rock about its longitudinal axis to accomodate misalignment of the contacts. Thus the available operating force is generally equally divided between the contacts without requiring any flexing of either contact leaf.

Figure 3:
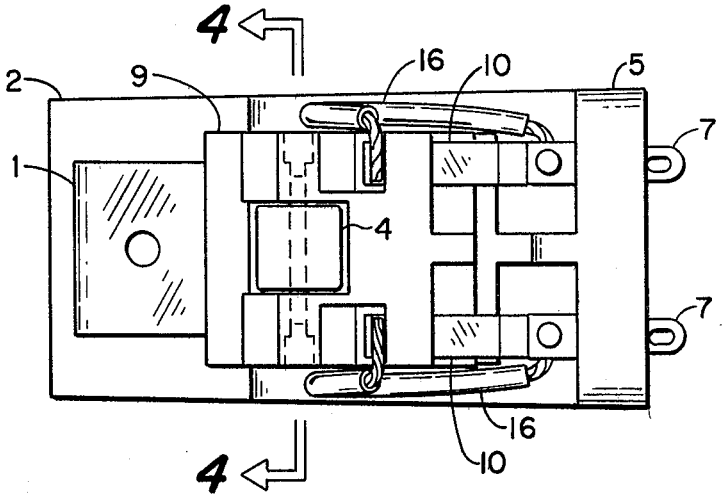
FIG. 3 is a top view of the switch.
Figure 4:
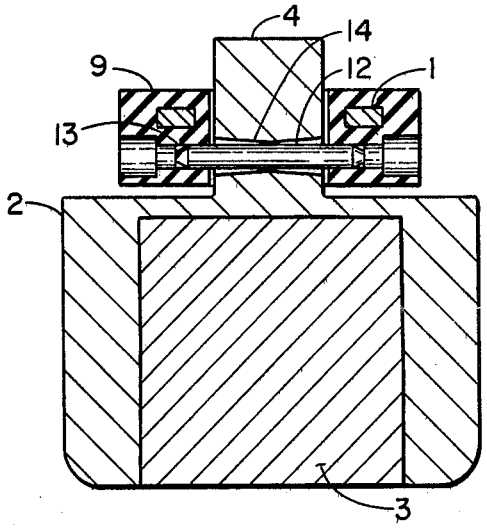
FIG. 4 is an enlarged section as seen from the line 4—4 of FIG. 3.

This action is apparent, as shown in FIGS. 3 and 4, when it is noted that the contacts 6 are spaced apart by the width of the armature 1 while the point of contact between the pivot pin 12 and the wall of the hole 14 in the pedestal 4 is somewhere within the width of the pedestal. Thus, regardless of the contact misalignments from dimensional tolerances the available operating force is distributed between the contacts ensuring that both sets of contacts are always operable.

I claim:

1. In a magnetically actuated double-pole proximity switch, in combination, a magnet assembly that comprises a magnet that is magnetized transversely of its length, a set of spaced apart fixed contacts mounted in the assembly adjacent an end of the magnet, and a pedestal extending from a face of the magnet, said pedestal having a transverse hole, and an armature assembly pivotally mounted on the magnet assembly, said armature assembly comprising an armature that extends generally parallel to the magnet and that has a centrally located hole in which said pedestal is loosely received, a pivot pin that is fixed to the armature and is loosely received in the hole in the pedestal, and a pair of spaced apart contacts mounted on and insulated from the armature and that cooperate with the fixed contacts and pivot pin to position the armature in the field of the magnet.

* * * * *